US008801489B2

(12) United States Patent
Koshida et al.

(10) Patent No.: US 8,801,489 B2
(45) Date of Patent: Aug. 12, 2014

(54) TOY VEHICLE

(71) Applicant: Bandai Co., Ltd., Tokyo (JP)

(72) Inventors: Kenji Koshida, Tokyo (JP); Akane Miyata, Tokyo (JP); Yumi Kanaoka, Tokyo (JP); Ayumi Hasegawa, Tokyo (JP); Naohiro Yoshino, Tokyo (JP); Takayuki Shinoda, Tokyo (JP)

(73) Assignee: Bandai Co., Ltd., Tokyo (JP)

( * ) Notice: Subject to any disclaimer, the term of this patent is extended or adjusted under 35 U.S.C. 154(b) by 91 days.

(21) Appl. No.: 13/658,763

(22) Filed: Oct. 23, 2012

(65) Prior Publication Data

US 2013/0109273 A1 May 2, 2013

(30) Foreign Application Priority Data

Nov. 1, 2011 (JP) ..... 2011-239918
Nov. 29, 2011 (JP) ..... 2011-259882

(51) Int. Cl.
*A63H 33/00* (2006.01)

(52) U.S. Cl.
USPC ..... 446/71; 446/78; 446/465

(58) Field of Classification Search
USPC ..... 446/71, 72, 78, 471
IPC ..... A63H 19/00,33/003, 17/004, 17/02; B62B 7/12

See application file for complete search history.

(56) References Cited

U.S. PATENT DOCUMENTS 1,973,220 A * 9/1934 Mohr ..... 446/94
2,597,094 A * 5/1952 Gutmann ..... 446/6
4,477,999 A * 10/1984 Harigai et al. ..... 446/470
2011/0070801 A1 3/2011 Furusawa et al.

FOREIGN PATENT DOCUMENTS

JP 58-032790 A 2/1983
JP 2011-067231 A 4/2011

* cited by examiner

*Primary Examiner* — Vishu K. Mendiratta
(74) *Attorney, Agent, or Firm* — Rabin & Berdo, P.C.

(57) ABSTRACT

A toy vehicle transformable between first and second forms includes an undercarriage, a top member having first and second surfaces serving as upper surfaces of the vehicle in the first and second forms, respectively, a front member rotatably connected to the front end portion of the top member, where the front member has first and second surfaces serving as front surfaces of the vehicle in the first and second forms, respectively, and a connector that connects the rear end portion of the top member to the undercarriage and that includes a separation rotation shaft for supporting the top member for rotation in a direction in which the top member moves away from the undercarriage and a turnover rotation shaft for supporting the top member for rotation in a direction in which the top member is turned over.

5 Claims, 11 Drawing Sheets

TOY VEHICLE

CROSS REFERENCES TO RELATED APPLICATIONS

The present invention contains subject matter related to Japanese Patent Application No. 2011-239918 filed in the Japanese Patent Office on Nov. 1, 2011, and Japanese Patent Application No. 2011-259882 filed in the Japanese Patent Office on Nov. 29, 2011, the entire contents of which are incorporated herein by reference.

BACKGROUND OF THE INVENTION

1. Field of the Invention

The present invention relates to a toy vehicle and, in particular, to a toy vehicle that is transformable from a first form to a second form that differs from the first form.

2. Description of the Related Art

Some existing toy vehicles have a plurality of members each having different external appearances on both sides. An operator rotates each of the members of a vehicle so that the member is turned over. Thus, the toy vehicle of one style is transformed to a different styled toy vehicle (refer to, for example, Japanese Unexamined Patent Application Publication No. 58-32790).

The toy vehicle described in Japanese Unexamined Patent Application Publication No. 58-32790 includes a support frame. The toy vehicle further includes body side walls, a body front wall, and body rear wall rotatably attached to the support frame for upward and downward rotation. By rotating the body side walls, the body front wall, and the body rear wall upward, the operator can change the external appearance of the toy vehicle.

SUMMARY OF THE INVENTION

However, in Japanese Unexamined Patent Application Publication No. 58-32790, to change the external appearance of the toy vehicle, the user needs to rotate each of the body side walls, the body front wall, and the body rear wall. Thus, it is difficult for children, who are the primary target users of the toy, to operate the toy and, therefore, it is difficult to change the external appearance of the toy vehicle.

In addition, in order to significantly change the external appearance of the toy, it is desirable that, for example, the sizes of the body wall and the front wall be maximized. However, according to the structure of the toy described in Japanese Unexamined Patent Application Publication No. 58-32790, since the body side wall and the front wall are attached to the support frame. Accordingly, if the body side wall and the front wall are formed to be large, the size of the support frame needs to be small. If the size of the support frame is small, it is difficult to maintain the strength required for a toy used by children.

Accordingly, the present invention provides a toy vehicle that allows the external appearance thereof to be easily changed and that has a high strength.

The present invention is characterized by the following configurations.

(1) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a front member rotatably connected to a front end portion of the top member, where the front member has a first surface serving as a front surface of the vehicle in the first form and a second surface serving as a front surface of the vehicle in the second form, and connecting means for connecting a rear end portion of the top member to the undercarriage. The connecting means includes a separation rotation shaft that supports the top member for rotation in a direction in which the top member moves away from the undercarriage and a turnover rotation shaft that supports the top member for rotation in a direction in which the top member is turned over.

(2) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a rear member rotatably connected to a rear end portion of the top member, where the rear member has a first surface serving as a rear surface of the vehicle in the first form and a second surface serving as a rear surface of the vehicle in the second form, and connecting means for connecting a front end portion of the top member to the undercarriage. The connecting means includes a separation rotation shaft that supports the top member for rotation in a direction in which the top member moves away from the undercarriage and a turnover rotation shaft that supports the top member for rotation in a direction in which the top member is turned over.

(3) In Configuration (1) or (2), the toy vehicle can include a side member rotatably connected to a side portion of the top member, where the side member has a first surface serving as a side surface of the vehicle in the first form and a second surface serving as a side surface of the vehicle in the second form.

(4) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a side member rotatably connected to a side portion of the top member, where the side member has a first surface serving as a side surface of the vehicle in the first form and a second surface serving as a side surface of the vehicle in the second form, and connecting means for connecting the top member to the undercarriage. The connecting means includes a separation rotation shaft that supports the top member for rotation in a direction in which the top member moves away from the undercarriage and a turnover rotation shaft that supports the top member for rotation in a direction in which the top member is turned over.

(5) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, and connecting means for connecting the top member to the undercarriage. The connecting means includes a separation rotation shaft that supports the top member for rotation in a direction in which the top member moves away from the undercarriage and a turnover rotation shaft that supports the top member for rotation in a direction in which the top member is turned over.

(6) In any one of Configurations (1) to (5), the toy vehicle can further include a gear-shaped engaged member disposed on an outer periphery of the turnover rotation shaft and a pawl unit that is engaged with a valley portion of the gear-shaped engaged member. When the top member is rotated about the turnover rotation shaft, the pawl unit can slide over a peak of the engaged member and rotationally move along the valley and the peak.

(7) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a front member rotatably connected to a front end portion of the top member, where the front member has a first surface serving as a front surface of the vehicle in the first form and a second surface serving as a front surface of the vehicle in the second form, and connecting means for connecting a rear end portion of the top member to the undercarriage. The connecting means includes a spherical portion disposed on one of the top member and the undercarriage and an embracing portion disposed on the other of the top member and the undercarriage. The embracing portion rotatably embraces the spherical portion, and the connecting means supports the top member for rotation in a direction in which the top member moves away from the undercarriage and supports the top member for rotation in a direction in which the top member is turned over.

(8) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a rear member rotatably connected to a rear end portion of the top member, where the rear member has a first surface serving as a rear surface of the vehicle in the first form and a second surface serving as a rear surface of the vehicle in the second form, and connecting means for connecting a front end portion of the top member to the undercarriage. The connecting means includes a spherical portion disposed on one of the top member and the undercarriage and an embracing portion disposed on the other of the top member and the undercarriage. The embracing portion rotatably embraces the spherical portion, and the connecting means supports the top member for rotation in a direction in which the top member moves away from the undercarriage and supports the top member for rotation in a direction in which the top member is turned over.

(9) In Configuration (7) or (8), the toy vehicle can further include a side member rotatably connected to a side portion of the top member, where the side member has a first surface serving as a side surface of the vehicle in the first form and a second surface serving as a side surface of the vehicle in the second form.

(10) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a side member rotatably connected to a side portion of the top member, where the side member has a first surface serving as a side surface of the vehicle in the first form and a second surface serving as a side surface of the vehicle in the second form, and connecting means for connecting the top member to the undercarriage. The connecting means includes a spherical portion disposed on one of the top member and the undercarriage and an embracing portion disposed on the other of the top member and the undercarriage. The embracing portion rotatably embraces the spherical portion, and the connecting means supports the top member for rotation in a direction in which the top member moves away from the undercarriage and supports the top member for rotation in a direction in which the top member is turned over.

(11) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, and connecting means for connecting the top member to the undercarriage. The connecting means includes a spherical portion disposed on one of the top member and the undercarriage and an embracing portion disposed on the other of the top member and the undercarriage. The embracing portion rotatably embraces the spherical portion, and the connecting means supports the top member for rotation in a direction in which the top member moves away from the undercarriage and supports the top member for rotation in a direction in which the top member is turned over.

(12) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a front member rotatably connected to a front end portion of the top member, where the front member has a first surface serving as a front surface of the vehicle in the first form and a second surface serving as a front surface of the vehicle in the second form, and connecting means for connecting a rear end portion of the top member to the undercarriage. The connecting means includes a foldable thin plate unit that supports the top member for rotation in a direction in which the top member moves away from the undercarriage and a turnover rotation shaft that supports the top member for rotation in a direction in which the top member is turned over.

(13) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a rear member rotatably connected to a rear end portion of the top member, where the rear member has a first surface serving as a rear surface of the vehicle in the first form and a second surface serving as a rear surface of the vehicle in the second form, and connecting means for connecting a front end portion of the top member to the undercarriage. The connecting means includes a foldable thin plate unit that supports the top member for rotation in a direction in which the top member moves away from the undercarriage and a turnover rotation shaft that supports the top member for rotation in a direction in which the top member is turned over.

(14) In Configuration (12) or (13), the toy vehicle can further include a side member rotatably connected to a side portion of the top member, the side member having a first surface serving as a side surface of the vehicle in the first form and a second surface serving as a side surface of the vehicle in the second form.

(15) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, a side member rotatably connected to a side portion of the top member, where the side member has a first surface serving as a side surface of the vehicle in the first form and a second surface serving as a side surface of the vehicle in the second form, and connecting means for connecting the top member to the undercarriage. The connecting means includes a foldable thin plate unit that supports the top member for rotation in a direction in which the top member moves away from the undercarriage and a turnover rotation shaft that supports the top member for rotation in a direction in which the top member is turned over.

(16) A toy vehicle is transformable between a first form and a second form. The toy vehicle includes an undercarriage that forms a lower portion of the vehicle, a top member provided on the upper side of the undercarriage, where the top member has a first surface serving as an upper surface of the vehicle in the first form and a second surface serving as an upper surface of the vehicle in the second form, and connecting means for connecting the top member to the undercarriage. The connecting means includes a foldable thin plate unit that supports the top member for rotation in a direction in which the top member moves away from the undercarriage and a turnover rotation shaft that supports the top member for rotation in a direction in which the top member is turned over.

(17) In any one of Configurations (12) to (16), the toy vehicle can further include a gear-shaped engaged member disposed on an outer periphery of the turnover rotation shaft and a pawl unit that is engaged with a valley portion of the gear-shaped engaged member. When the top member is rotated about the turnover rotation shaft, the pawl unit can slide over a peak of the engaged member and rotationally move along the valley and the peak.

(18) In any one of Configurations (1), (7), and (12), when the top member is turned over, the front member is rotatable in a direction in which it turns over due to its own weight.

(19) In any one of Configurations (2), (8), and (13), when the top member is turned over, the rear member is rotatable in a direction in which it turns over due to its own weight.

(20) In any one of Configurations (3), (4), (9), (10), (14), and (15), when the top member is turned over, the side member is rotatable in a direction in which it turns over due to its own weight.

(21) In any one of Configurations (1) to (20), the first surface of the top member can include a portion representative of a characteristic of the first form, and the undercarriage can have a through-hole capable of receiving and hiding the portion representative of the characteristic of the first form when the toy vehicle is in the second form.

According to the toy vehicle of the present invention, the external appearance of the toy vehicle can be easily changed. In addition, the structure having high strength can be provided.

BRIEF DESCRIPTION OF THE DRAWINGS

FIG. 6A illustrates the operation of a separation rotation shaft, and FIG. 6B illustrates the operation of a turnover rotation shaft;

FIG. 7A illustrates the operation of a hinge unit, FIG. 7B illustrates the operation of the separation rotation shaft, and FIG. 7C is a side view of the toy vehicle in the second form;

DESCRIPTION OF THE PREFERRED EMBODIMENTS

Figure 1:
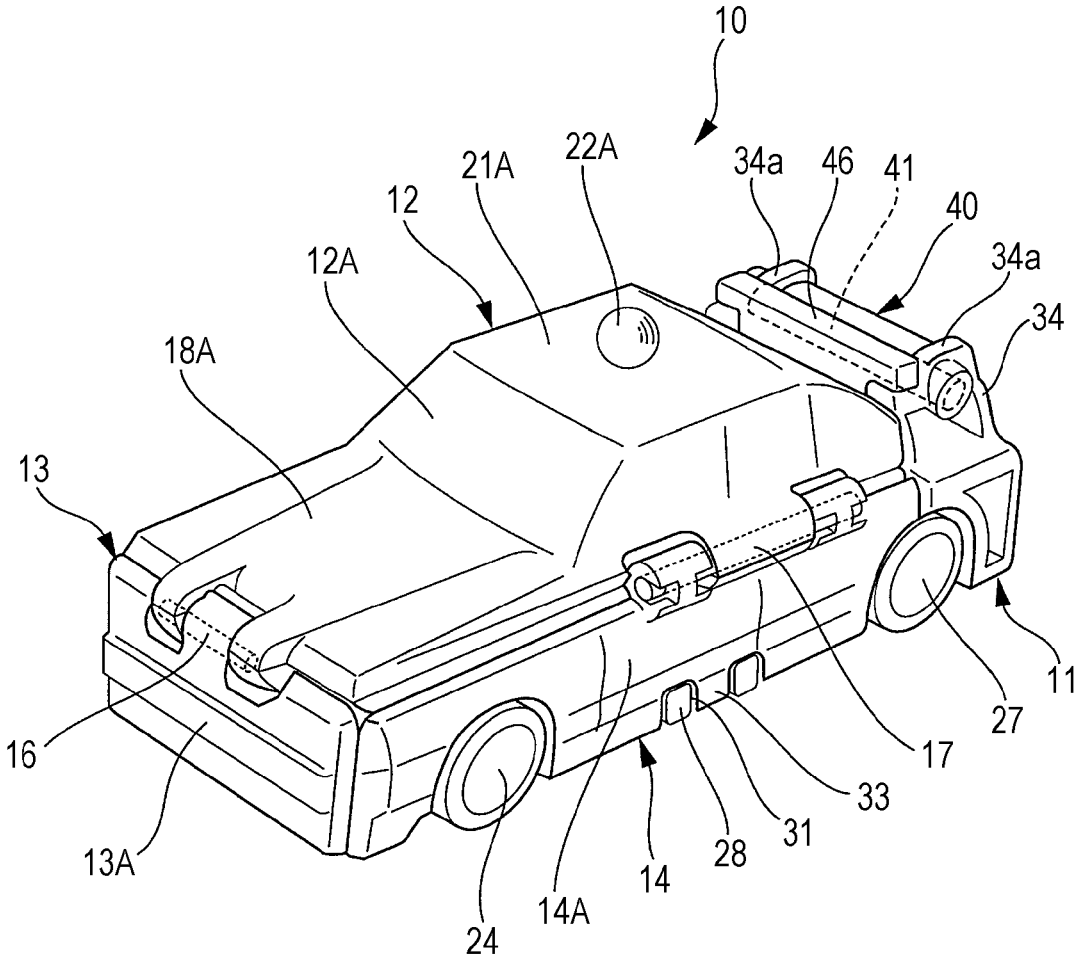
FIG. 1 is a perspective view of a toy vehicle according to an exemplary embodiment of the present invention.

Exemplary embodiments of the present invention are described in detail below with reference to the accompanying drawings. Note that the same reference numerals are used throughout the description of the embodiments to identify the same elements and blocks.

As illustrated in FIG. 1, a toy vehicle 10 is a sedan toy vehicle. The toy vehicle 10 includes an undercarriage 11 forming the lower portion of the vehicle, a top member 12 forming the upper side of the vehicle, a front member 13 forming the front side of the vehicle, and right and left side members 14 each forming a side of the vehicle. By turning over all of such members, a first form of the toy vehicle 10 can be changed into a second form that differs from the first form.

The upper edge of the front member 13 is connected to the front edge of the top member 12 using a hinge 16. The front member 13 is rotatable about the hinge 16 relative to the top member 12. Note that the front member 13 may be removable from the top member 12 at the hinge 16. The upper edge of the side member 14 is connected to a side edge of the top member 12 using a hinge 17. The side member 14 is rotatable about the hinge 17 relative to the top member 12. Note that the side member 14 may be removable from the top member 12 in the hinge 17. The top member 12 is connected to the undercarriage 11 using connecting means 40 so as to be rotatable in two directions. A mechanism that allows the top member 12 to be rotatable in two directions is described below. Note that the top member 12 may be removable from the undercarriage 11 at the connecting means 40.

FIG. 1 illustrates the toy vehicle 10 of the first form. The top member 12, the front member 13, and each of the side members 14 have a first surface 12A, a first surface 13A, and a first surface 14A that represent the surfaces of the vehicle in the first form and that face outward, respectively. In the first form, a second surface (described in more detail below) of each of the members is located inside of the toy vehicle 10. Thus, the second surface is negligibly visible from the outside. Note that for clarity, the reference symbol of the first surface of each of the members for the first form includes the alphabetic character "A" as a suffix, while the reference symbol of the second surface of each of the members for the second form includes the alphabetic character "B" as a suffix.

The first surface 12A of the top member 12 includes a front hood section 18A and a roof panel section 21A disposed behind the front hood section 18A. A spherical portion 22A is provided in the middle of the roof panel section 21A. The spherical portion 22A represents one of the characteristics of the first form.

Figure 2:
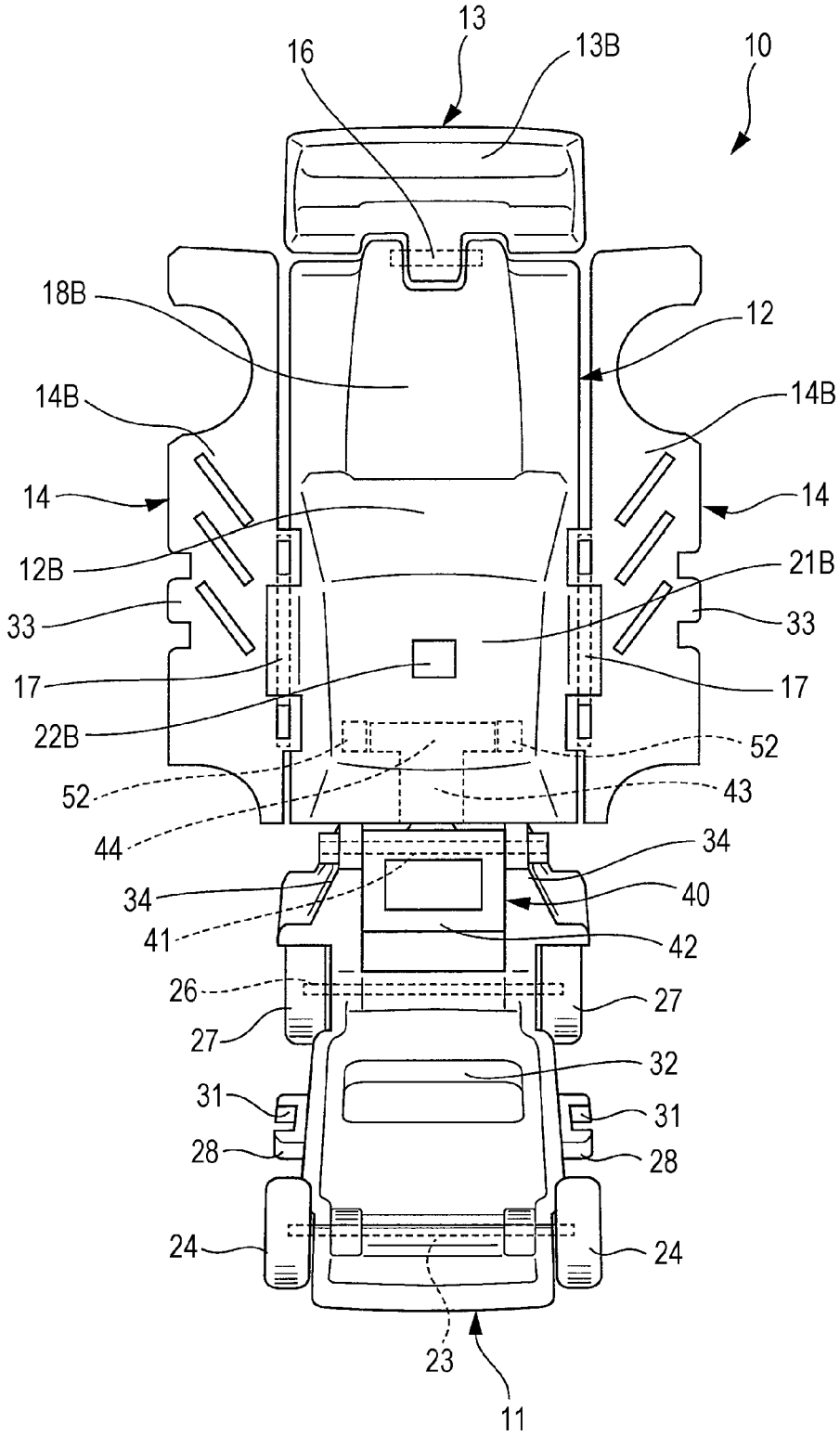
FIG. 2 is perspective view illustrating second surfaces of members of the toy vehicle.

FIG. 2 illustrates the toy vehicle 10 having the top member 12, the front member 13, and the side member 14 each rotated about 90°. Thus, in FIG. 2, the second surfaces of the top member 12, the front member 13, and the side member 14 are illustrated. As illustrated in FIG. 2, the front portion of the undercarriage 11 has right and left wheels 24 rotatably disposed therein via a front wheel axle 23. The rear portion of the undercarriage 11 has right and left wheels 27 rotatably disposed therein via a rear wheel axle 26. In addition, each of the right and left side ends of the undercarriage 11 has a protrusion tip 28 that protrudes laterally. The protrusion tip 28 includes a notch 31 that is U-shaped and opens upwardly and laterally. The middle portion of the undercarriage 11 has a rectangular through-hole 32.

The top member 12, the front member 13, and the side member 14 have second surfaces 12B, 13B, and 14B that form the surfaces of the vehicle in a second form, respectively. The second surface 12B of the top member 12 includes a front hood section 18B, a roof panel section 21B disposed behind the front hood section 18B. A rectangular column portion 22B is provided in the middle of the roof panel section 21B. The rectangular column portion 22B represents one of the characteristics of the second form.

In addition, in the first and second forms, the top member 12 is supported by the upper surface of the undercarriage 11. In the first form, the second surface 12B is supported by the upper surface of the undercarriage 11, and the rectangular column portion 22B is disposed in the through-hole 32 without being in contact with the upper surface of the undercarriage 11. In contrast, in the second form, the first surface 12A (refer to FIG. 1) is supported by the upper surface of the undercarriage 11, and the spherical portion 22A (refer to FIG. 1) is disposed in the through-hole 32 without being in contact with the upper surface of the undercarriage 11. Furthermore, by, through the through-hole 32, touching and pressing the rectangular column portion 22B if the vehicle is of the first form or touching and pressing the spherical portion 22A if the vehicle is of the second form, the user can start rotating the top member 12 in a direction in which the top member 12 moves away from the undercarriage 11.

The side member 14 has a fitting tip 33 that mates with the notch 31 of the undercarriage 11. Since the notch 31 is U-shaped and opens upwardly and laterally, the fitting tip 33 can be fitted into the notch 31 from above and the side. In this way, the toy vehicle 10 can remain in the first or second form.

Figure 3:
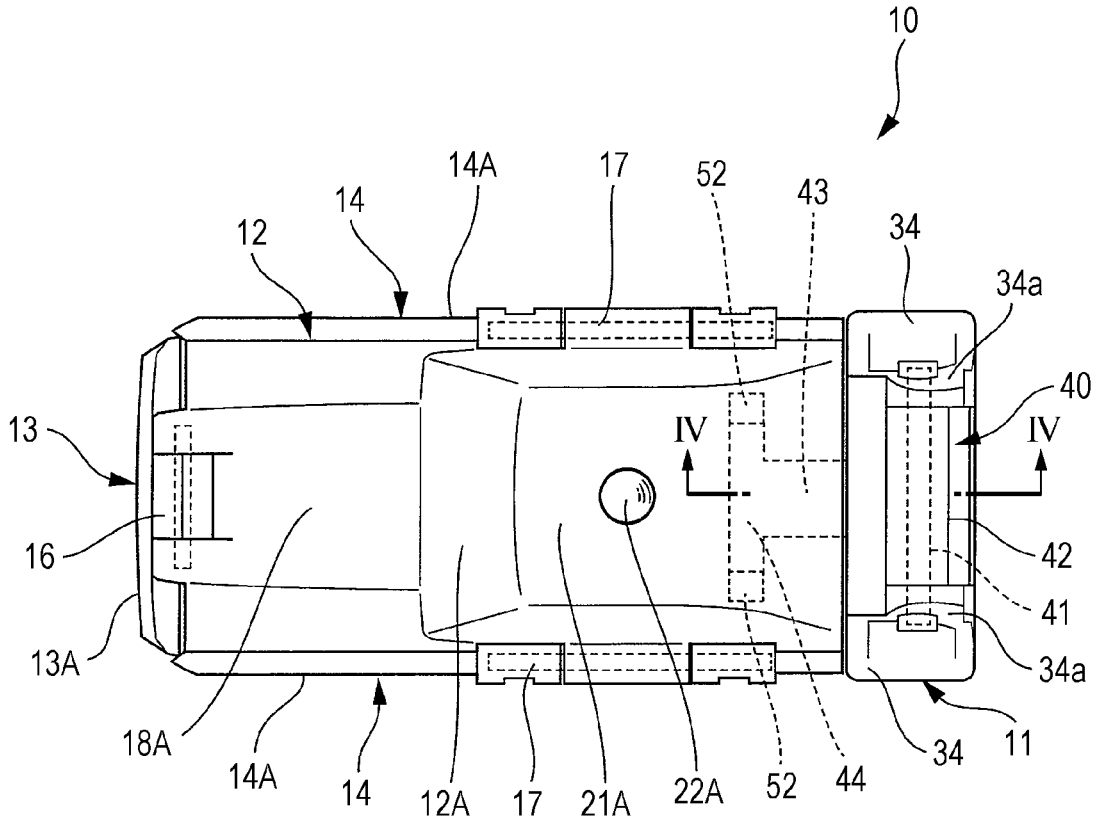
FIG. 3 is a plan view of the toy vehicle.

The connecting means 40 and the structure in its vicinity are described next with reference to FIGS. 3 to 5. As illustrated in FIG. 3, the upper rear section of the undercarriage 11 has right and left support portions 34 formed therein. The connecting means 40 is disposed between the right and left support portions 34. The connecting means 40 includes a separation rotation shaft 41 having both ends supported by the right and left support portions 34, a rotation member 42 rotatably supported by the separation rotation shaft 41, a turnover rotation shaft 43 that extends forward from the rotation member 42, and a gear-shaped engaged member 44 disposed on the outer periphery of the turnover rotation shaft 43.

Figure 4:
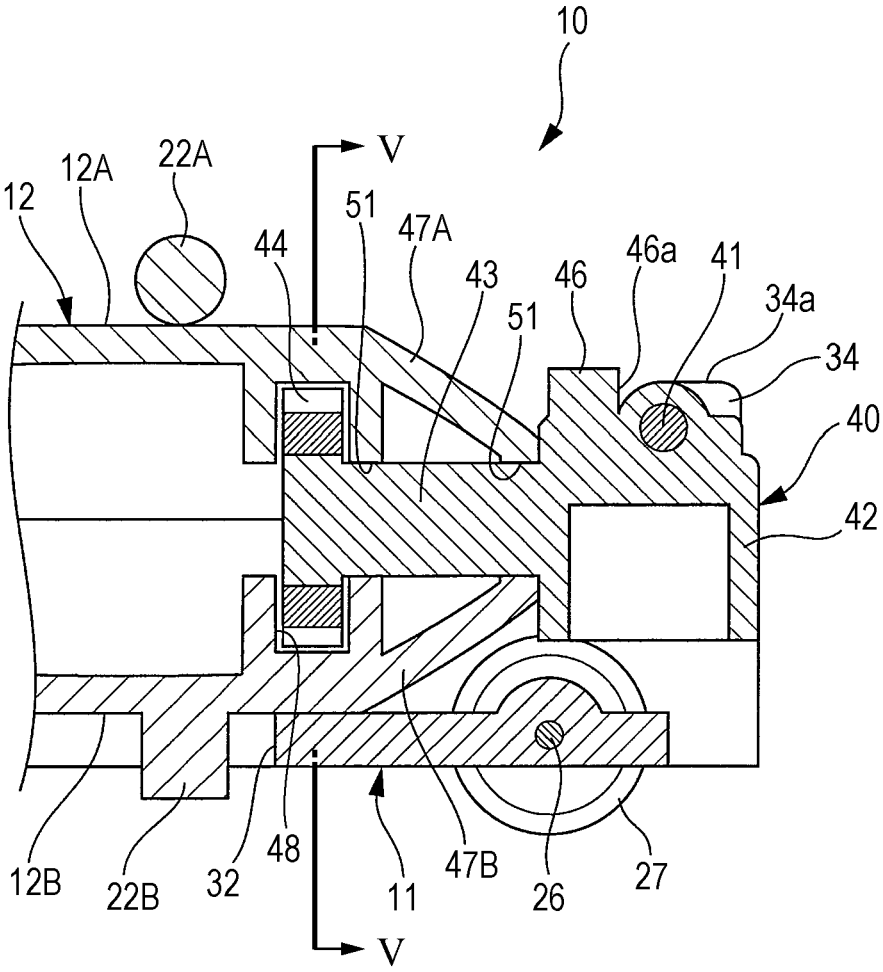
FIG. 4 is a cross-sectional view taken along a line IV-IV of FIG. 3.

As illustrated in FIG. 4, the rotation member 42 includes a rotation regulation unit 46 that extends in the right-left direction in the vicinity of the front portion of the separation rotation shaft 41. If the rotation member 42 rotates by a predetermined angle, a rear surface 46*a* of the rotation regulation unit 46 is bought into contact with an upper surface 34*a* of each of the right and left support portions 34. In this manner, the rotation regulation unit 46 regulates the rotation angle of the rotation member 42. According to the present exemplary embodiment, the angle formed by the rear surface 46*a* and the upper surface 34*a* is set to 90° and, therefore, the maximum rotational angle of the rotation member 42 is set to 90°. However, the maximum rotational angle is not limited to a particular value. The maximum rotational angle can be set to any desired value.

The top member 12 separates into two in a direction from the first surface to the second surface. That is, the top member 12 includes a first surface side separation member 47A that forms the first surface 12A and a second surface side separation member 47B that forms the second surface 12B. By combining the first surface side separation member 47A and the second surface side separation member 47B with each other, a storage portion 48 for storing the engaged member 44 and a bearing unit 51 for supporting the turnover rotation shaft 43 can be formed inside the top member 12.

The turnover rotation shaft 43 is inserted so as to be sandwiched by the first surface side separation member 47A and the second surface side separation member 47B and is supported by the bearing unit 51. Thus, the top member 12 is supported for rotation about the separation rotation shaft 41 in such a direction that the top member 12 moves away from the undercarriage 11 (in the upward direction). At the same time, the top member 12 is supported for rotation about the turnover rotation shaft 43 in such a direction that the top member 12 is turned over.

Figure 5:
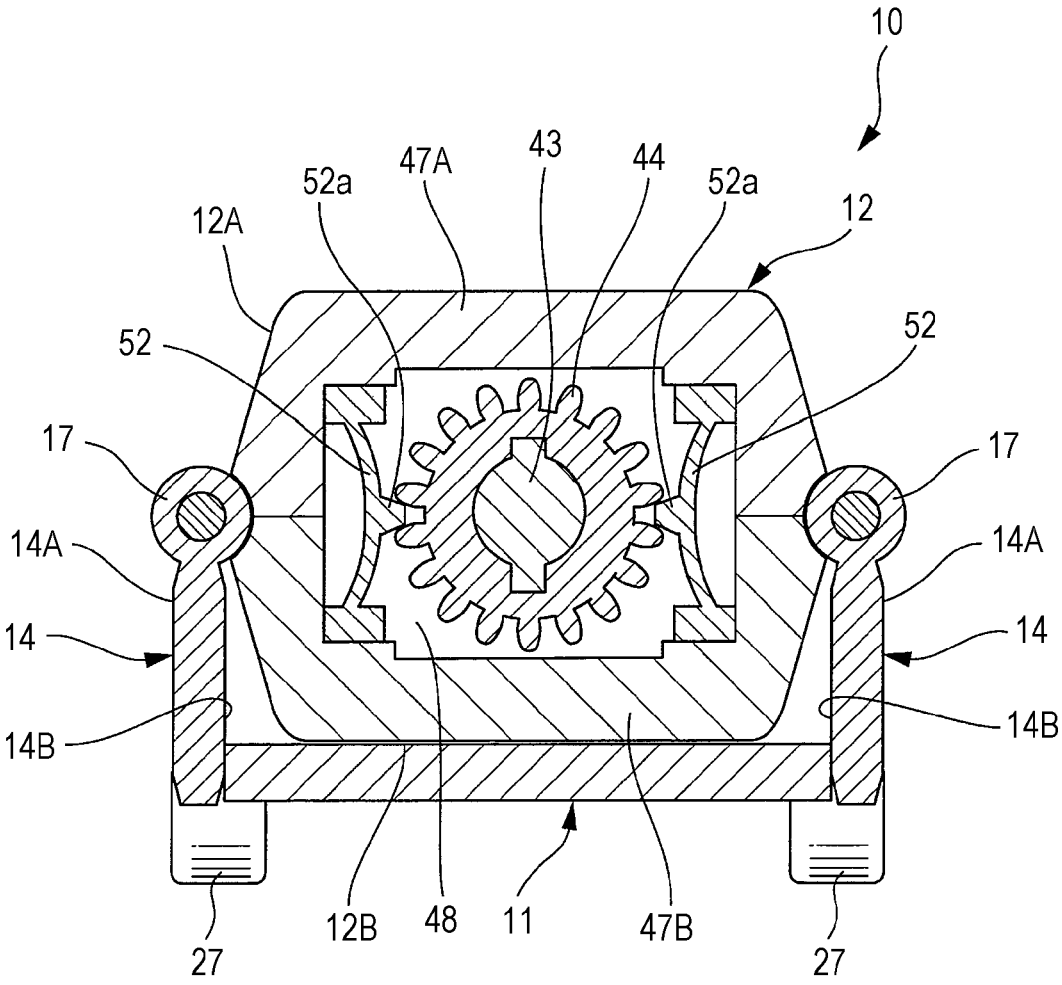
FIG. 5 is a cross-sectional view taken along a line V-V of FIG. 4.

As illustrated in FIG. 5, an engagement member 52 is secured on each of the right and left sides of the engaged member 44 stored in the storage portion 48. The engagement member 52 is resiliently deformable. The engagement member 52 includes a pawl unit 52*a* that protrudes inward. The pawl unit 52*a* is engaged with a valley portion of the gear-shaped engaged member 44. When the top member 12 is rotated about the turnover rotation shaft 43, the pawl unit 52*a* is released from the valley portion in the outward direction and slides over a peak of the engaged member 44. In this way, the engagement members 52 rotate along the valleys and the peaks of the engaged member 44. Therefore, the user who operates the top member 12 can receive a click sensation caused by the movement of the pawl unit 52*a*.

Figure 6A:
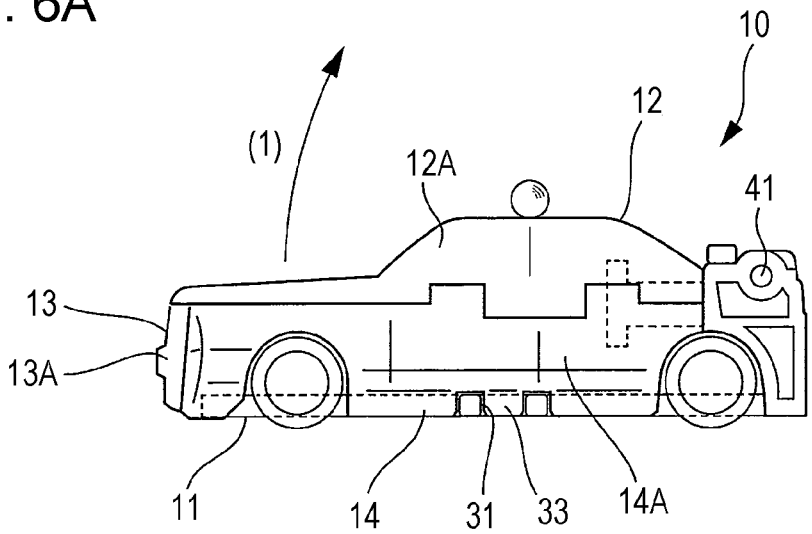
FIGS. 6A and 6B illustrate a procedure of transforming the toy vehicle according to the exemplary embodiment, where

A procedure to transform the toy vehicle 10 from the first form to the second form according to the present exemplary embodiment is described next with reference to FIGS. 6A and 6B and FIGS. 7A to 7C. FIG. 6A is a side view of the toy vehicle 10 in the first form. The user operates, for example, the side members 14 first to separate the fitting tip 33 from the notch 31. Thereafter, the user rotates the top member 12 about the separation rotation shaft 41 in a direction indicated by an arrow (1), that is, in a direction in which the top member 12 moves away from the undercarriage 11. At that time, the front member 13 and the side members 14 are connected to only the top member 12. Accordingly, the front member 13 and the side member 14 rotate together with the top member 12 in the direction in which the top member 12 moves away from the undercarriage 11. Note that at that time, since the notch 31 opens upwardly, the fitting tip 33 may be upwardly separated from the notch 31 by simply rotating the top member 12 in the direction in which the top member 12 moves away from the undercarriage 11, without separating the fitting tip 33 from the notch 31 through the operation performed on, for example, the side member 14 in advance.

Figure 6B:
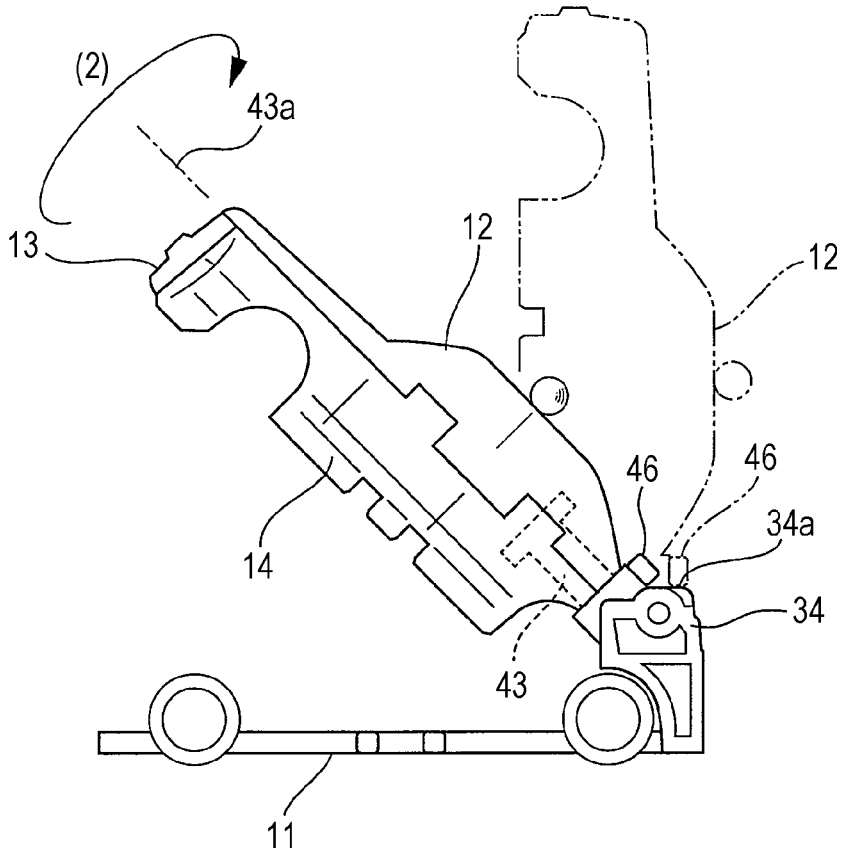

As illustrated in FIG. 6B, if the top member 12 is sufficiently rotated, a space is formed between the undercarriage 11 and each of the top member 12, the front member 13, and the side members 14. Subsequently, by using such a space, the user rotates the top member 12 about an axis line 43*a* of the turnover rotation shaft 43 in a direction indicated by an arrow (2), that is, in such a direction that the top member 12 is turned over.

Figure 7A:
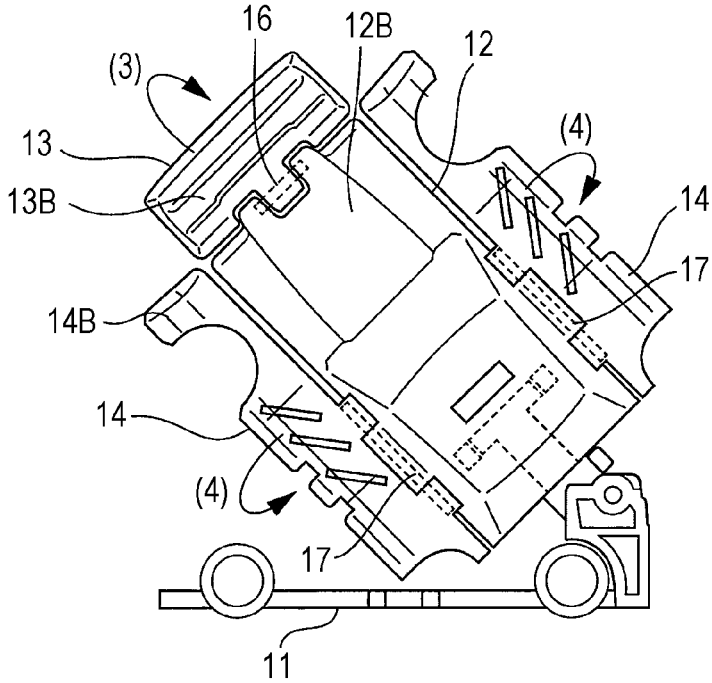
FIGS. 7A to 7C illustrate a procedure of transforming the toy vehicle according to an exemplary embodiment, where

When the top member 12 is turned over, the front member 13 and the side members 14 can be turned over at the hinge units 16 and 17, respectively, due to their own weights. Accordingly, as illustrated in FIG. 7A, when the top member 12 is turned over, the front member 13 and the side members 14 can rotate about the hinge units 16 and 17 in directions indicated by arrows (3) and (4), respectively, that is, in such directions that the front member 13 and the side member 14 are turned over due to their own weights without the user intervention. That is, by rotating the top member 12 in the direction in which the top member 12 moves away from the undercarriage 11 and, subsequently, rotating the top member 12 in the direction in which the top member 12 is turned over, the user can concurrently rotate the front member 13 and the side member 14 in such a direction that the front member 13 and the side member 14 are turned over. This design allows even a young child, who is a primary target user, to easily transform the form of the toy vehicle 10.

Figure 7B:
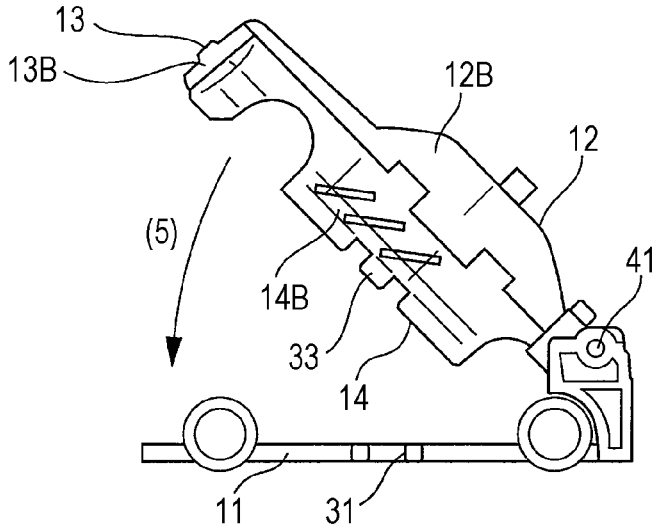

When the top member 12 is turned over and if each of the front member 13 and the side members 14 is rotated 180° with respect to the top member 12 in the above-described manner, the first surface of each of the members faces the inside of the toy vehicle 10 and are hidden. At that time, the second surfaces 12B, 13B, and 14B that are previously hidden appear, as illustrated in FIG. 7B. Thereafter, if the top member 12 is rotated about the separation rotation shaft 41 in a direction indicated by arrow (5), that is, in a direction in which the top member 12 moves closer to the undercarriage 11, the top member 12, the front member 13, and the side members 14 return to the undercarriage 11. At that time, as illustrated in FIG. 7B, since the notch 31 opens upwardly, the fitting tip 33 can be easily fitted into the notch 31 from above by rotating the top member 12 with the fitting tip 33 facing downward in a direction in which the top member 12 moves closer to the undercarriage 11.

Figure 7C:
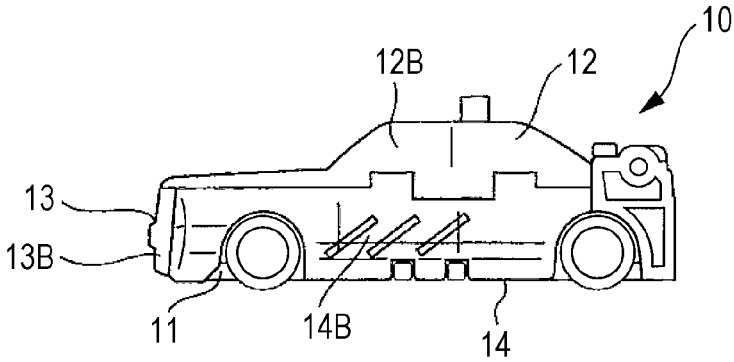

As a result, as illustrated in FIG. 7C, the toy vehicle 10 including the undercarriage 11 having the members with the second surfaces 12B, 13B, and 14B facing outward can be obtained. In this manner, the toy vehicle 10 is transformed into the second form. By performing the same operations as described above, the user can transform the toy vehicle 10 from the second form into the first form.

While the above-described example has been described with reference to the operation in which the front member 13 and the side members 14 are rotated relative to the top member 12 and, thereafter, are returned to the undercarriage 11, the top member 12 may be returned to the undercarriage 11 first and, thereafter, the rotation of the front member 13 or the side members 14 may be completed. In such a case, since the notch 31 also opens laterally, the fitting tip 33 can be fitted into the notch 31 from the side.

According to the toy vehicle described above, by simply raising the top member 12, turning over the top member 12, and rotating the front member 13 and the side members 14, the external appearance of the toy vehicle 10 can be easily changed. That is, the members need not be individually rotated relative to the undercarriage 11. In addition, since the front member 13 and the side members 14 are connected to the top member 12, a support frame that is used in existing toy vehicles is unnecessary. As a result, the structure having high strength can be obtained.

Furthermore, when rotating the top member 12, the user can receive a click sensation due to the presence of the engaged member 44 and the engagement member 52. The user can enjoy the click sensation associated with a rotating operation.

Still furthermore, as indicated by an alternate long and two short dashes line illustrated in FIG. 6B, by allowing the rotation regulation unit 46 to be brought into contact with the upper surface 34*a* of each of the right and left support portions 34, the rotational angle of the rotation member 42 can be regulated. In this manner, excessive rotation of the top member 12 can be prevented. Accordingly, the toy vehicle 10 can be more easily transformed from one form to the other.

Figure 8:
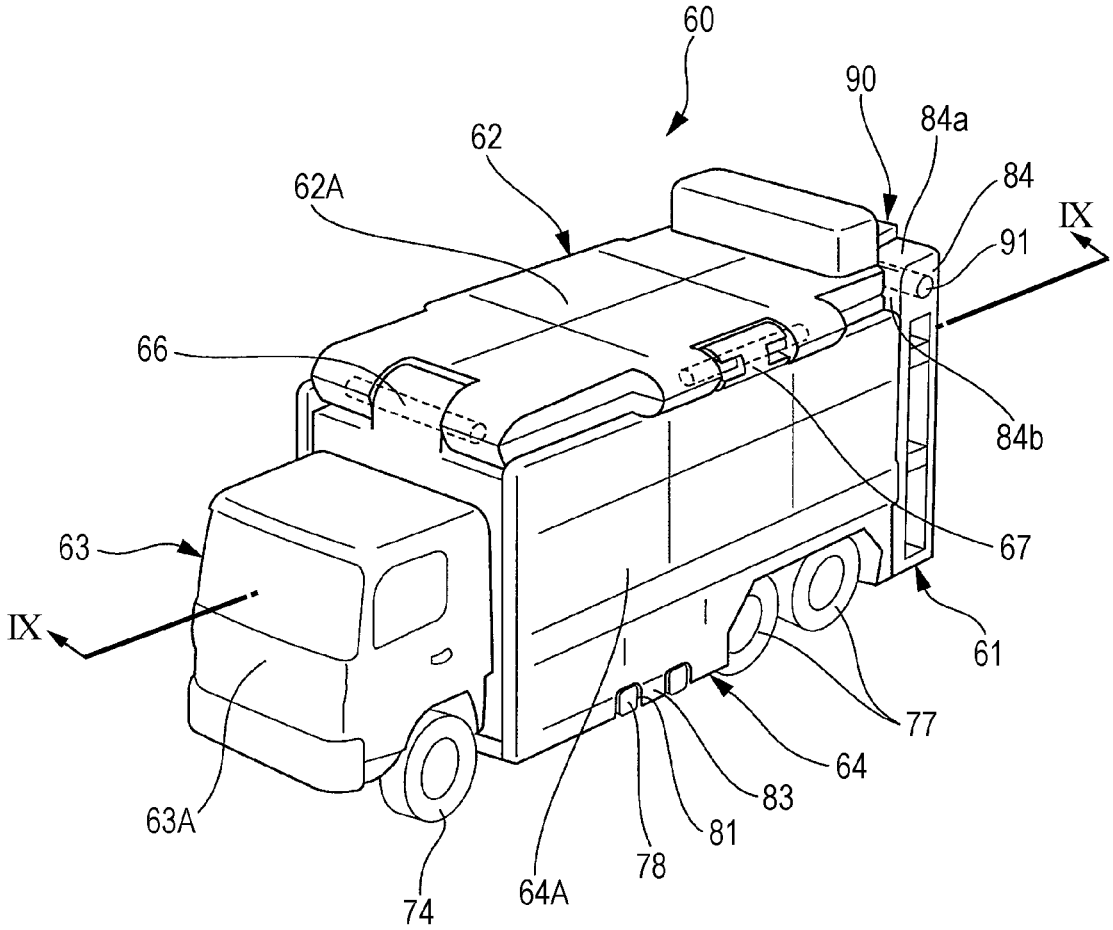
FIG. 8 is a perspective view of a toy vehicle according to another exemplary embodiment.

A toy vehicle according to another exemplary embodiment is described next with reference to FIGS. 8 to 11. As illustrated in FIG. 8, a toy vehicle 60 is a toy heavy vehicle. The toy vehicle 60 includes an undercarriage 61 forming the lower portion of the vehicle, a top member 62 forming the upper side of a cargo area body (the upper side of the vehicle), a front member 63 forming a vehicle compartment (the front side of the vehicle), and a side members 64 forming a right and left sides of the cargo area body (sides of the vehicle). Like the toy vehicle 10, by turning over each of such members, the toy vehicle 60 can be transformed from a first form to a second form.

The undercarriage 61 has right and left front wheels 74 and two pairs consisting of right and left rear wheels 77 rotatably attached thereto. In addition, each of the right and left side ends of the undercarriage 61 has a protrusion tip 78 that protrudes laterally. The protrusion tip 78 includes a notch 81 that is U-shaped and that opens upwardly and laterally.

The upper edge of the front member 63 is connected to the front edge of the top member 62 using a hinge unit 66. The front member 63 is rotatable about the hinge unit 66 relative to the top member 62. Note that the front member 63 may be removable from the top member 62 at the hinge unit 66. The lower end of the front member 63 is supported by the upper surface of the undercarriage 61. The upper edge of each of the side members 64 is connected to a side edge of the top member 62 using a hinge unit 67. The side member 64 is rotatable about the hinge unit 67 relative to the top member 62. Note that the side member 64 may be removable from the top member 62 at the hinge unit 67. The top member 62 is connected to the undercarriage 61 using connecting means 90 so as to be rotatable in two directions. A mechanism that allows the top member 62 to be rotatable in two directions is described below. Note that the top member 62 may be removable from the undercarriage 11 at the connecting means 90.

FIG. 8 illustrates the first form of the toy vehicle 60 modeled after a truck. The top member 62, the front member 63, and each of the side members 64 have a first surface 62A, a first surface 63A, and a first surface 64A that represent the surfaces of the vehicle in the first form and that face outward, respectively. In the first form, a second surface (described in more detail below) of each of the members is located inside of the toy vehicle 60. Thus, the second surface is negligibly visible from the outside. Note that for clarity, the reference symbol of the first surface of each of the members for the first form includes the alphabetic character "A" as a suffix, while the reference symbol of the second surface of each of the members for the second form includes the alphabetic character "B" as a suffix.

Each of the side members 64 has a fitting tip 83 that mates with the notch 81 of the undercarriage 61. Since the notch 81 is U-shaped and opens upwardly and laterally, the fitting tip 83 can be fitted into the notch 81 from above and the side. In this way, the toy vehicle 60 can remain in the first or second form.

Figure 9:
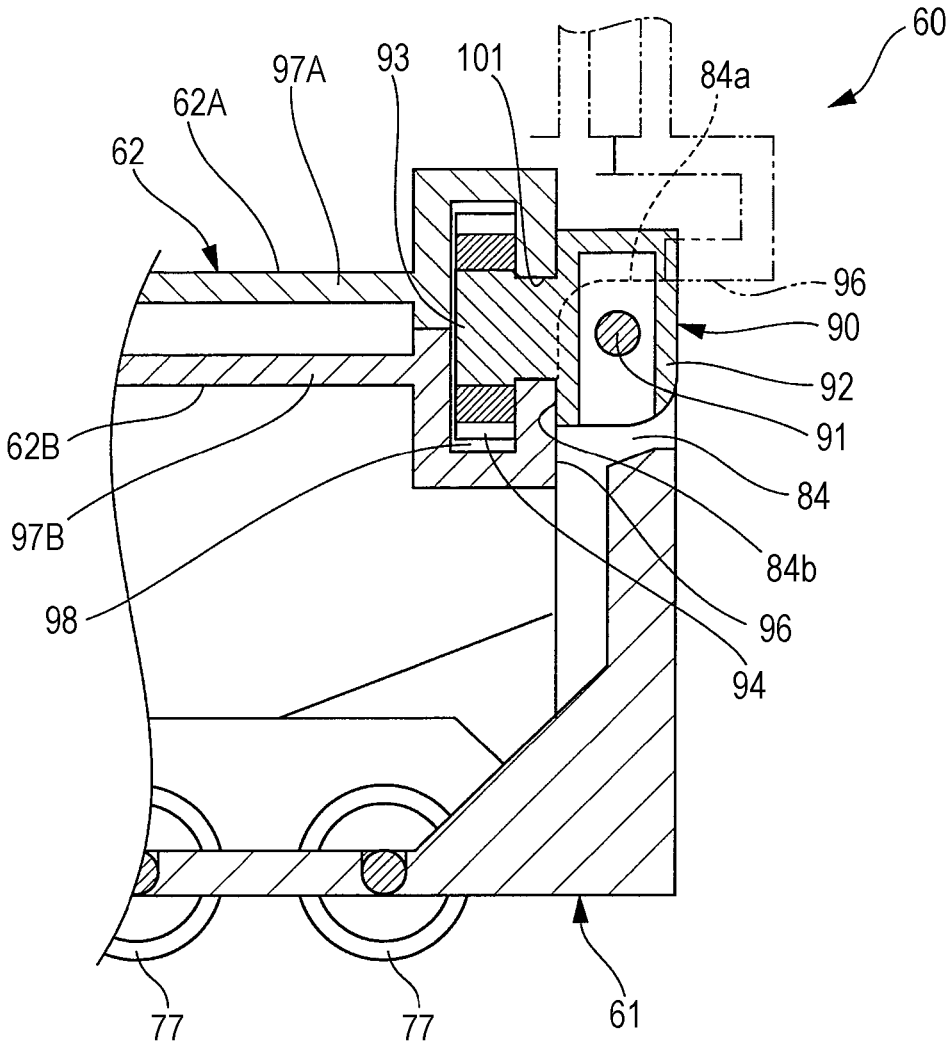
FIG. 9 is a cross-sectional view taken along a line IX-IX of FIG. 8 and illustrates the structure of connecting means and its vicinity.

The connecting means 90 and the structure in its vicinity are described next with reference to FIG. 9. As illustrated in FIG. 9, the upper section of the rear wall of the undercarriage 61 has right and left support portions 84 formed therein (only the right support portion is illustrated in the drawing). The connecting means 90 is disposed between the right and left support portions 84. The connecting means 90 includes a separation rotation shaft 91 having both ends supported by the right and left support portions 84, a rotation member 92 rotatably supported by the separation rotation shaft 91, a turnover rotation shaft 93 that extends forward from the rotation member 92, and a gear-shaped engaged member 94 disposed on the outer periphery of the turnover rotation shaft 93.

The top member 62 is a plate-like member that can be separated into two in a direction from the first surface to the second surface. Thus, the top member 62 includes a first surface side separation member 97A that forms the first surface 62A and a second surface side separation member 97B that forms the second surface 62B. The rear end portions of the first surface side separation member 97A and the second surface side separation member 97B are formed into shapes protruding toward each other (upward and downward). Thus, the top member 62 has a space formed therein. By combining the first surface side separation member 97A and the second surface side separation member 97B with each other, a storage portion 98 for storing the engaged member 94 and a bearing unit 101 for supporting the turnover rotation shaft 93 are formed in the rear end portion of the top member 62.

The turnover rotation shaft 93 is inserted so as to be sandwiched by the first surface side separation member 97A and the second surface side separation member 97B and is supported by the bearing unit 101. Thus, the top member 62 is supported for rotation about the separation rotation shaft 91 in such a direction that the top member 62 moves away from the undercarriage 61 (in the upward direction). At the same time, the top member 62 is supported for rotation about the turnover rotation shaft 93 in such a direction that the top member 62 is turned over.

A rear end surface 96 of the top member 62 regulates the rotation of the top member 62 about the separation rotation shaft 91. That is, in the first form or the second form, the rear end surface 96 is in contact with a front surface 84*b* of each of the support portions 84 and stops downward rotation of the top member 62. In contrast, if the top member 62 rotates upwardly by a predetermined angle, the rear end surface 96 of the top member 62 is brought into contact with an upper surface 84*a* of each of the right and left support portions 84, as indicated by an alternate long and two short dashes line in the drawing. Thus, rotation of the top member 62 is prevented. In this example, the angle formed by the rear end surface 96 and the upper surface 84*a* is set to 90° and, therefore, the maximum rotational angle of the top member 62 is set to 90°. However, the maximum rotational angle is not limited to a particular value. The maximum rotational angle can be set to any desired value.

An engagement member (not illustrated) that is similar to the engagement member 52 (refer to FIG. 5) is secured on each of the right and left side of the engaged member 94 stored in the storage portion 98. Accordingly, like the toy vehicle 10, the user who operates the top member 62 can receive a click sensation caused by the movement of a pawl unit of the engaged member.

Figure 10:
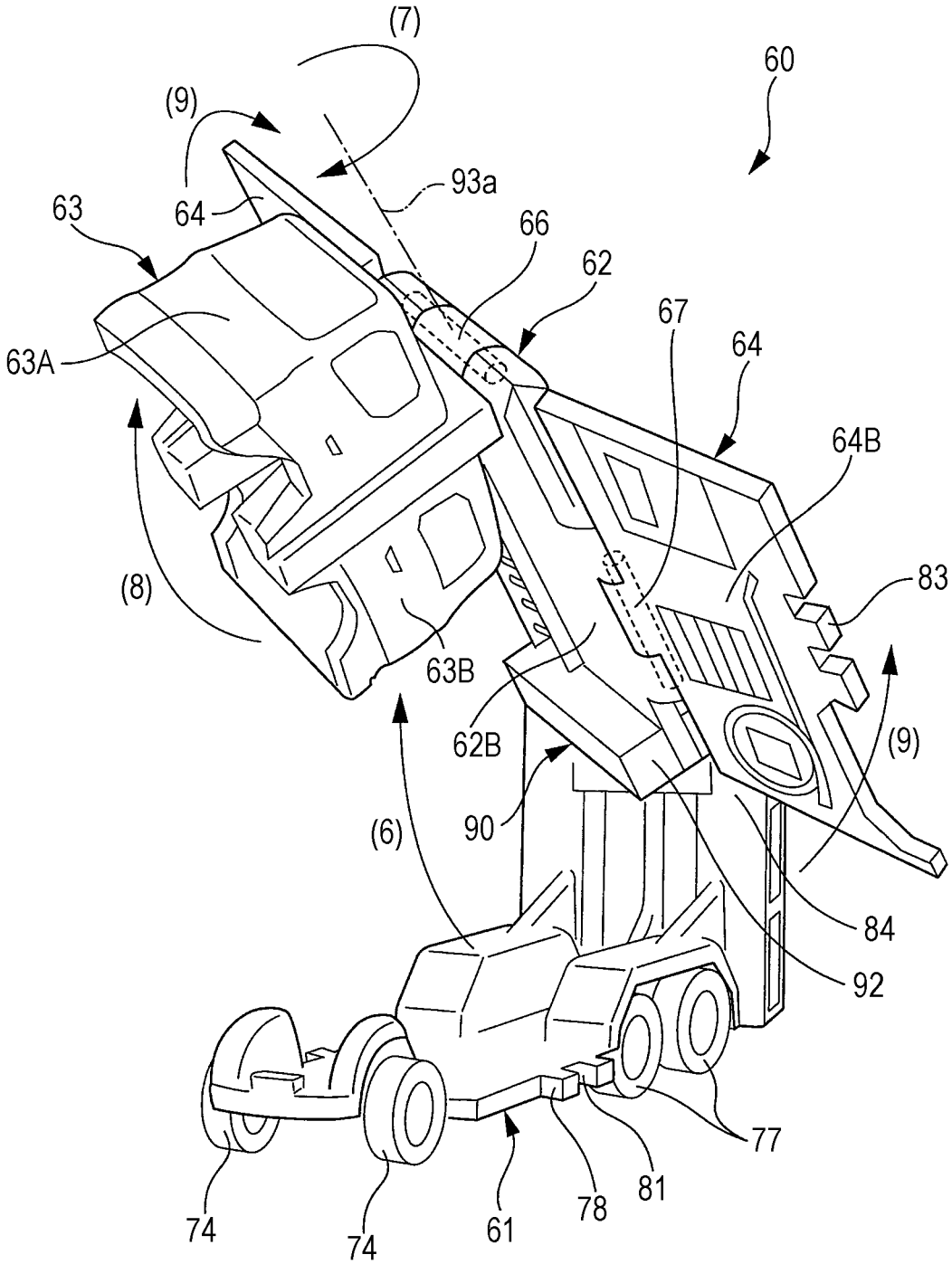
FIG. 10 illustrates a procedure of transforming the toy vehicle according to the exemplary embodiment and is a perspective view of the toy vehicle.

Like the above-described exemplary embodiment, the toy vehicle 60 according to the present exemplary embodiment can be transformed from the first form to the second form through an operating procedure that is the same as the procedure for the toy vehicle 10. The user operates, for example, the side member 64 first to separate the fitting tip 83 from the notch 81. Thereafter, as illustrated in FIG. 10, the user rotates the top member 62 about the separation rotation shaft 91 in a direction indicated by an arrow (6), that is, in a direction in which the top member 62 moves away from the undercarriage 61. At that time, the front member 63 and the side members 64 are connected to only the top member 62. Accordingly, the front member 63 and the side members 64 rotate together with the top member 62 in the direction in which the top member 62 moves away from the undercarriage 61. Note that at that time, since the notch 81 opens upwardly, the fitting tip 83 can be upwardly separated from the notch 81 by simply rotating the top member 62 in the direction in which the top member 62 moves away from the undercarriage 61, without separating the fitting tip 83 from the notch 81 through the operation performed on, for example, the side member 64 in advance.

Subsequently, by sufficiently rotating the top member 62, a space is formed between the undercarriage 61 and each of the top member 62, the front member 63, and the side members 64. Thereafter, by using such a space, the user rotates the top member 62 about an axis line 93*a* of the turnover rotation shaft 93 in a direction indicated by an arrow (7), that is, in such a direction that the top member 62 is turned over.

When the top member 62 is turned over, the front member 63 and the side members 64 can turn over about the hinge units 66 and 67, respectively, due to their own weights. Accordingly, when the top member 62 is turned over, the front member 63 and the side member 64 can rotate about the hinge units 66 and 67 in directions indicated by arrows (8) and (9), respectively, that is, in such directions that the front member 63 and the side member 64 are turned over due to their own weights without the user intervention. That is, by rotating the top member 62 in the direction in which the top member 62 moves away from the undercarriage 61 and, subsequently, rotating the top member 62 in a direction in which the top member 62 is turned over, the user can concurrently rotate the front member 63 and the side members 64 in such a direction that the front member 63 and the side members 64 are turned over. This design allows even a young child, who is a primary target user, to easily transform the toy vehicle 60 from one form into the other.

When the top member 62 is turned over and if each of the front member 63 and the side members 64 is rotated 180° with respect to the top member 62 in the above-described manner, the first surface of each of the members faces the inside of the toy vehicle 60 and is hidden. In contrast, the second surfaces 62B, 63B, and 64B that are previously hidden are exposed to the outside. Thereafter, if the top member 62 is rotated about the separation rotation shaft 91 (refer to FIG. 9) in a direction in which the top member 62 moves closer to the undercarriage 61, the top member 62, the front member 63, and the side members 64 return to the undercarriage 61. At that time, since the notch 81 opens upwardly, the fitting tip 83 can be easily fitted into the notch 81 from above by rotating the top member 62 with the fitting tip 83 facing downward in a direction in which the top member 62 moves closer to the undercarriage 61.

Figure 11:
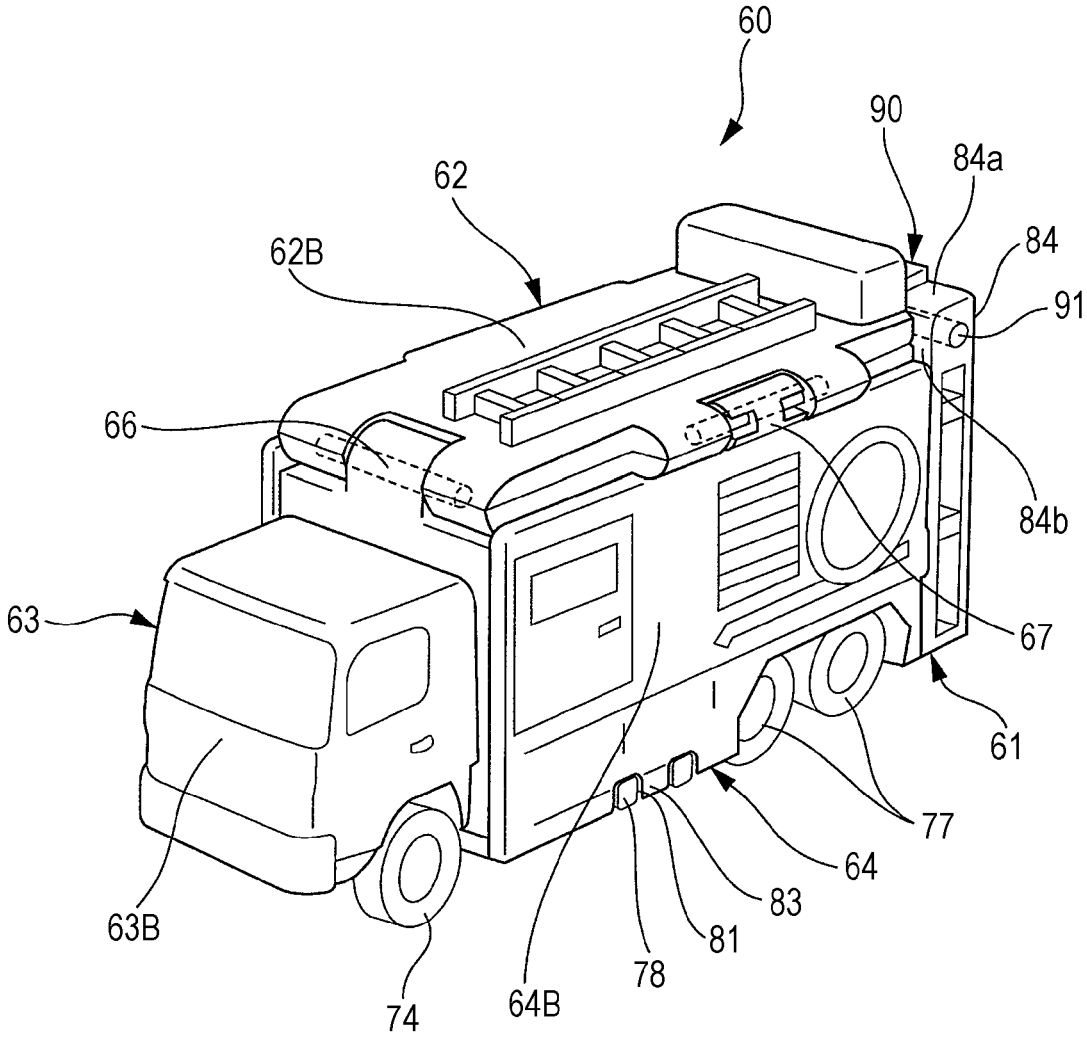
FIG. 11 is a side view of the toy vehicle transformed into the second form according to the exemplary embodiment.

As a result, as illustrated in FIG. 11, the toy vehicle 60 resembling a fire engine and including the undercarriage 61 having the members with the second surfaces 62B, 63B, and 64B facing outward can be obtained. In this manner, the toy vehicle 60 is transformed into the second form. By performing the same operations as described above, the user can transform the toy vehicle 60 from the second form into the first form. The toy vehicle 60 according to the present exemplary embodiment can provide the operation and the advantages that are the same as those of the toy vehicle 10 according to the above-described exemplary embodiment.

Although the invention has been shown and described with reference to the foregoing embodiments, the technical scope of the invention is not limited to the technical scopes of the above-described exemplary embodiments. It will be understood by those skilled in the art that various changes can be made to these exemplary embodiments without departing from the spirit and scope of the invention. In addition, it will be understood that the embodiment subjected to such changes are also encompassed in the scope of the present invention.

For example, while the foregoing exemplary embodiments have been described with reference to the structure in which the front member is connected to the front portion of the top member and the connecting means is provided in the rear portion of the top member, the rear member that forms the rear surface of the vehicle may be connected to the rear portion of the top member and connecting means may be provided in the front portion of the top member.

In addition to the connecting means formed from the separation rotation shaft and the turnover rotation shaft, a variety of modifications of the connecting means can be provided. For example, the connecting means may be formed from a spherical portion provided on one of the undercarriage and the top member and an embracing member that is provided on the other of the undercarriage and the top member and that rotatably embraces the spherical portion. Even such a connecting member can support the top member for rotation in a direction in which the top member moves away from the undercarriage and supports the top member that is separated from the undercarriage for rotation in a direction in which the top member is turned over. Furthermore, the separation rotation shaft may be replaced with a foldable thin plate unit. Even such a thin plate unit can support the top member for rotation in a direction in which the top member moves away from the undercarriage.

What is claimed is:

1. A toy vehicle transformable between a first form and a second form, comprising:

an undercarriage that forms a lower portion of the vehicle;

a top member provided on the upper side of the undercarriage, the top member having a first surface serving as an upper surface of the vehicle in the first form and a second surface serving as an upper surface of the vehicle in the second form;

a front member rotatably connected to a front end portion of the top member, the front member having a first surface serving as a front surface of the vehicle in the first form and a second surface serving as a front surface of the vehicle in the second form; and connecting means for connecting a rear end portion of the top member to the undercarriage;

wherein the connecting means includes a separation rotation shaft that supports the top member for rotation in a direction in which the top member moves away from the undercarriage and a turnover rotation shaft mounted perpendicular to the separation rotation shaft, that supports the top member for rotation in a direction in which the top member is turned over.

2. The toy vehicle according to claim 1, further comprising:

a side member rotatably connected to a side portion of the top member, the side member having a first surface serving as a side surface of the vehicle in the first form and a second surface serving as a side surface of the vehicle in the second form.

3. The toy vehicle according to claim 1, further comprising:

a gear-shaped engaged member disposed on an outer periphery of the turnover rotation shaft; and a pawl unit that is engaged with a valley portion of the gear-shaped engaged member;

wherein when the top member is rotated about the turnover rotation shaft, the pawl unit slides over a peak of the engaged member and rotationally moves along the valley and the peak.

4. The toy vehicle according claim 1, wherein when the top member is turned over, the front member is rotatable in a direction in which it turns over due to its own weight.

5. The toy vehicle according to claim 1, wherein the first surface of the top member includes a portion representative of a characteristic of the first form, and wherein the undercarriage has a through-hole capable of receiving and hiding the portion representative of the characteristic of the first form when the toy vehicle is in the second form.

* * * * *